United States Patent [19]

Teschner et al.

[11] 4,085,852

[45] Apr. 25, 1978

[54] METHOD AND APPARATUS FOR DETERMINING THE COVERING OF A COKE WHARF WITH QUENCHED COKE

[75] Inventors: Wolfgang Teschner, Ratingen-Hosel; Hans-Jürgen von Massow, Recklinghausen, both of Germany

[73] Assignee: Firma Carl Still Recklinghausen, Germany

[21] Appl. No.: 729,020

[22] Filed: Oct. 4, 1976

[30] Foreign Application Priority Data

Oct. 9, 1975 Germany ..... 2545264

[51] Int. Cl.[2] ..... C10B 39/18

[52] U.S. Cl. ..... 214/17 R; 214/152; 222/64; 340/244 C

[58] Field of Search ..... 214/16 R, 17 R, 18 R, 214/152; 202/227, 262; 340/244 C, 246, 244 R; 73/304 R, 304 C; 222/52, 56, 64

[56] References Cited

U.S. PATENT DOCUMENTS

| | | | |
|---|---|---|---|
| 2,766,406 | 10/1956 | Schwarzkopf | 340/244 R X |
| 3,231,104 | 1/1966 | Lawrence | 214/17 R |

*Primary Examiner*—Robert G. Sheridan

*Attorney, Agent, or Firm*—McGlew and Tuttle

[57] ABSTRACT

A wharf for receiving glowing coke, comprises an inclined receiving ramp which has a plurality of non-conducting areas and conductive plates interposed in the conductive areas at spaced locations. An electrical circuit control means is connected to each of the plates and provides a potential on the plates which will vary in accordance with the presence of coke over the plates. The electrical circuit also includes a control for effecting a control pulse in accordance with the potential sensed for carrying out a subsequent operation, such as the positioning or withdrawal of a rake element at the bottom of the wharf which supports the coke. With the method, by subjecting the conductive plates to an electrical potential, and by sensing the change in the potential, it is possible to regulate the amount of covering of the coke on the wharf.

6 Claims, 2 Drawing Figures

METHOD AND APPARATUS FOR DETERMINING THE COVERING OF A COKE WHARF WITH QUENCHED COKE

FIELD AND BACKGROUND OF THE INVENTION

This invention relates in general to the construction of wharfs for receiving coke from coke ovens and, in particular, to a new and useful wharf which has a plurality of electrically conductive plates which are subjected to a potential and which are positioned along the wharf over which the coke is piled and which provide a means for indicating the quantity of coke on the wharf due to the change in the potential.

The present invention relates particularly to a method and apparatus for determining the covering of a coke wharf with quenched coke, while using electric current. In the prior art, for installing devices of this kind, gantry-type supporting steel structures are used and electrically operated rope probes are appropriately spaced from each other, for example, by 0.5 m, and are suspended from the structures and hang down close to the wharf surface, and they are responsive to coke pieces which are present. For example, electrical switches mounted in plummet-like probe bodies which are provided at the end of the probes may be actuated. The switches are connected in circuits equipped with indicators, or capacitances of the probe bodies and they may vary in response to the presence or absence of coke pieces, which are converted into current pulses and indicated. Such pulses may also be used for controlling purposes.

The erection of gantry-type structures spanning the coke wharf complicates the access thereto. The structures themselves are exposed to the corroding action of humid fumes emanating from the quenched coke and the rope probes or probe bodies are continually under strong mechanical strain and are pushed to and fro by the hard coke pieces so that the resulting service is very rough and the device as a whole is susceptible to failures.

A design is also known, according to which the entire coke wharf is set on pressure pickups and the pressure is electrically transmitted to a measuring device. In this manner, the covering can be more or less accuraaely monitored. This construction, however, is heavy and clumsy in handling.

SUMMARY OF THE INVENTION

The present invention is directed to a simple and nearly wear-free device which operates accurately and reliabily under the unfavorable environmental conditions of a coking plant service and in the presence of wet coke dust.

To solve the problem, the fact is utilized that relative to the ambience which is influenced by the environmental and service conditions, the quenched coke has a different specific resistance which, after being connected in an electrical circuit, makes it possible to securely start subsequent electrically controlled working or moving operations in connection with the coke removal from the wharf, for example, the actuation of baffle rakes at the lower end of the wharf or the processing of signals for an automatic control of the coke plant.

In accordance with the invention, plates or strips of a wear-resistant, electrically well-conducting material, for example, metal, are inserted flush into the electrically poorly conducting facing of the wharf and are broughtto an electric potential relative to that of the surrounding facing, and the change of potential produced as coke is dumped on the plates or strips and as they are cleared of coke is used for releasing a signal or for controlling subsequent moving operations in connection with the coke removal from the wharf.

Iron plates have proved sufficiently conducting, and cast-iron plates, in addition, provide highly wear-resistant inserts for this purpose. Such cast-iron plates may be provided over the entire height and width of the wharf, spaced by approximately 1 to 2 m.

Advantageously, an alternating or direct voltage of 6 to 24 V and an amperage of 1 to 10 mA are used for the operation of the device. For usual conditions, a voltage of 12 V and an amperage of 3.0 mA have proved completely satisfactory.

Accordingly, it is an object of the invention to provide a method of determining the covering of quenched coke on a coke wharf while using electric current connection to plates or strips of wear-resistant electrically well-conductive plates which are inserted flush into electrically poorly conductive facing of the wharf, comprising subjecting the electrically well-conducting material to an electric potential relative to that of the surrounding facing, sensing the change of the potential of the plates as the coke is dumped on plates and the facing and as the wharf is cleared of coke and controlling subsequent moving operations in accordance with the potential change effected due to the coke removal from the wharf.

A further object of the invention is to provide a wharf for receiving glowing coke which comprises an inclined receiving ramp having a plurality of non-conductive areas and conductive plates interposed in the areas at spaced locations, and including electric circuit control means connected to the plates and subjecting the plates to an electrical potential which varies in accordance with the covering of coke on the wharf and which includes control means effecting a control pulse in accordance with the potential sensed.

A further object of the invention is to provide a wharf construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
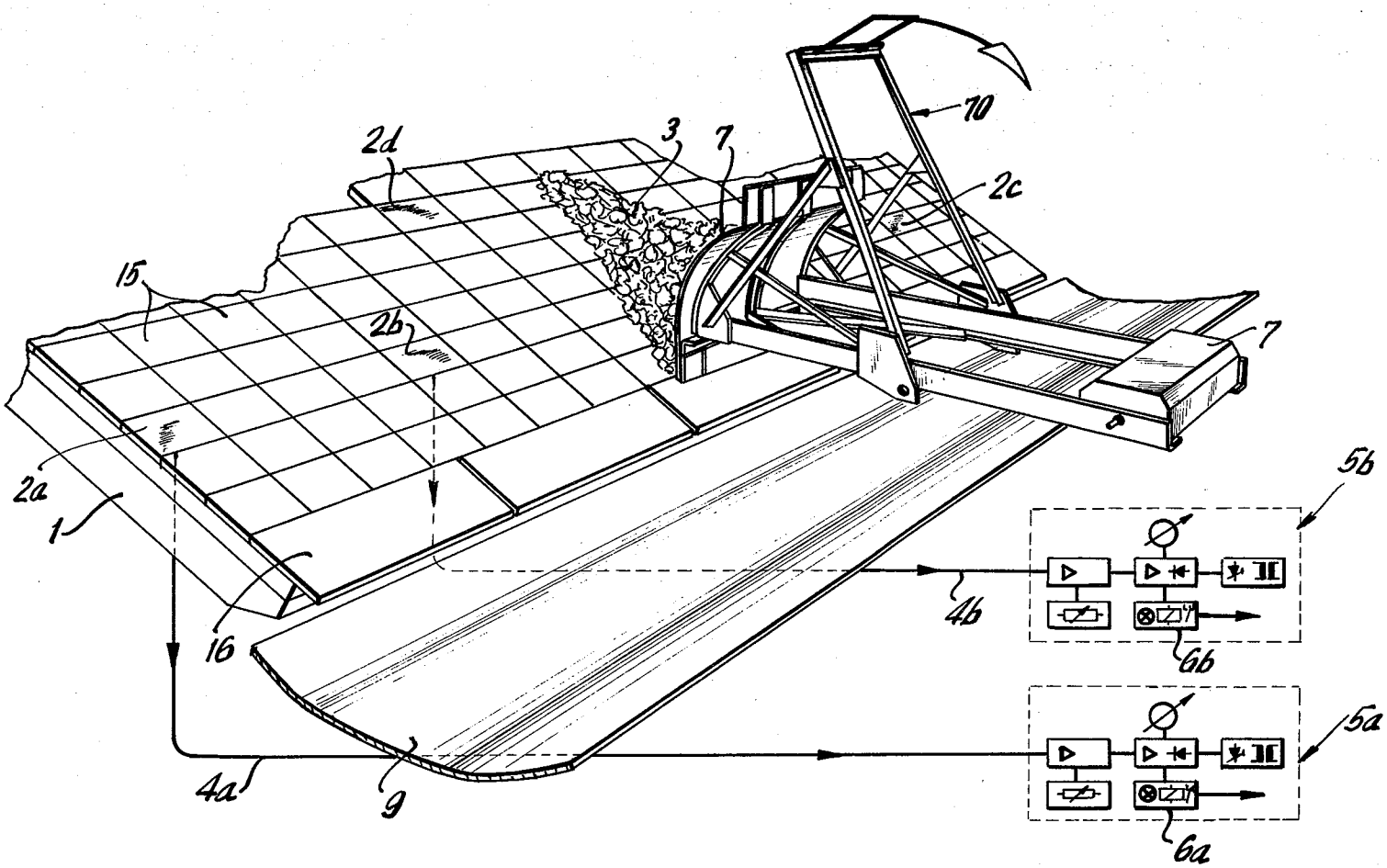
FIG. 1 is a perspective view of a lower portion of a ramp for receiving glowing coke constructed in accordance with the invention.
Figure 2:
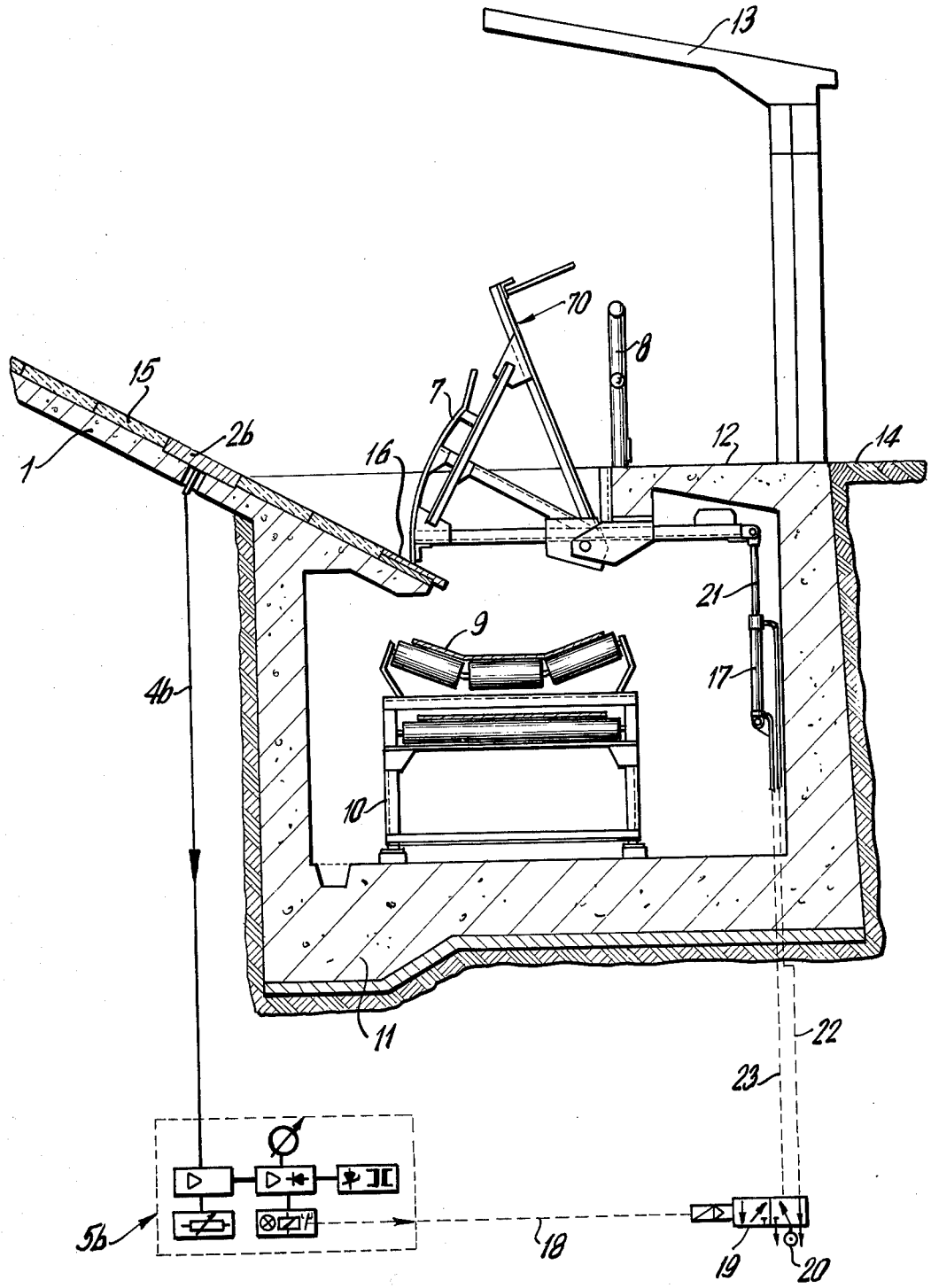
FIG. 2 is a transverse section of the wharf taken through the plate 2*b*.

Referring to the drawings in particular, the invention embodied therein, comprises an inclined coke wharf 1, having a surface area 15 of ceramic plates or other suitable nonconductive high temperature resistant material. In accordance with the invention, a plurality of electrically conductive plates are interposed in the non-conductive areas at spaced locations and, in the embodiment illustrated, there are plates 2a, 2b, 2c and 2d, and another plate which is hidden below a heap of coke 3. Cables 4a and 4b connect the plates 2a and 2b to circuitry units, generally designated 5a and 5b, which are symbolically indicated at 6a and 6b. The circuitry units include means for applying a potential to the plates and for sensing a change in potential in accordance with the variations of coke 3 which is positioned over the plates. The changes in potential produce output pulses which may be utilized for any closed or open loop control purpose, for example, for operating, adjusting and closing or opening a baffle rake mechanism, generally designated 70, for positioning a baffle rake 7. The plates include plates 2c and 2d which are connected similarly, but their connections are not shown.

The construction of the device also includes a guard rail 8, which is located at the end of a service passage 12 and under a shed 13 which extends up from ground level 14. The construction includes a foundation 11 in which is mounted a support 10 for a belt conveyor 9. The wharf lower edge includes cast iron border plates 16 upon which rake 7 rests.

For the automatic control of the wharf operation, an operating cylinder 17 having a piston rod 21 and pressure lines 22 and 23 are connected to a solenoid valve 19 for the pneumatic or hydraulic actuation of the baffle rake mechanism 70. The compressed air or oil fluid supply unit 20 is provided for pressurizing the system through the valve 19. A connecting line 18 extends between the circuitry unit 5b and solenoid valve 19.

While a specific embodiment of the invention has been shown and described in detail, to illustrate the application of the principles of the invention, it will be understood that the invention may be embodied otherwise without departing from such principles.

What is claimed is:

1. A method of determining the covering of quenched coke on a coke wharf while using electric current connected to plates or strips of wear-resistant, electrically well-conducting plates which are inserted flush into the electrically poorly conducting facing of the wharf, material to an electrical potential relative to that of the surrounding facing, sensing the change of the potential of the plates as the coke is dumped on the plates and facing and as they are being cleared of the coke, and controlling subsequent moving operations in accordance with the potential change effected with the coke removal from the wharf.

2. A method according to claim 1, wherein the conductive plates comprise a cast iron.

3. A method according to claim 1, wherein the conducting plates are provided at different levels on the wharf.

4. A method according to claim 1, wherein an alternating or direct voltage of from 6 to 24 V, with an amperage of from 1 to 10 mA, is applied to the plates.

5. A wharf for receiving glowing coke, comprising an inclined receiving ramp having a plurality of non-conductive areas and conductive plates interposed in said areas at spaced locations, electrical circuit control means connected to said plates and subjecting said plates to an electrical potential, said potential being variable in accordance with the coke overlying said plates, and said control means effecting a control pulse in accordance with the potential sensed.

6. A wharf for receiving glowing coke, according to claim 5, wherein said cast iron plates have a size of approximately 30 × 30 cm and spaced apart by about 1 meter and connecting to a source of alternating or direct current.

* * * * *